US010976132B2

(12) United States Patent
Pilkama

(10) Patent No.: US 10,976,132 B2
(45) Date of Patent: Apr. 13, 2021

(54) GUN SLING

(71) Applicant: FinSling Oy, Tuusula (FI)

(72) Inventor: Anssi Pilkama, Vantaa (FI)

(73) Assignee: FinSling Oy, Tuusula (FI)

( * ) Notice: Subject to any disclaimer, the term of this patent is extended or adjusted under 35 U.S.C. 154(b) by 0 days.

(21) Appl. No.: 16/820,816

(22) Filed: Mar. 17, 2020

(65) Prior Publication Data

US 2020/0333107 A1 Oct. 22, 2020

(30) Foreign Application Priority Data

Apr. 16, 2019 (FI) ..... 20195308

(51) Int. Cl.
*F41C 33/00* (2006.01)
*A45F 3/14* (2006.01)
*F41C 23/02* (2006.01)

(52) U.S. Cl.
CPC ..... *F41C 33/002* (2013.01); *A45F 3/14* (2013.01); *F41C 23/02* (2013.01); *A45F 2003/142* (2013.01); *A45F 2200/0591* (2013.01)

(58) Field of Classification Search
CPC ..... F41C 33/002; F41C 23/02
See application file for complete search history.

(56) References Cited

U.S. PATENT DOCUMENTS

| | | | | |
|---|---|---|---|---|
| 3,441,185 | A | 4/1969 | Moomaw | |
| 4,613,067 | A | 9/1986 | Gann | |
| 4,768,689 | A | 9/1988 | Davis | |
| 6,068,167 | A | 3/2000 | Hopson | |
| 6,325,258 | B1 | 12/2001 | Verdugo et al. | |
| 6,647,656 | B2 * | 11/2003 | Mazzagetti | F41C 33/002 224/150 |
| 7,959,046 | B2 | 6/2011 | Burnsed, Jr. et al. | |
| 9,157,700 | B1 | 10/2015 | Hansen | |
| 10,209,031 | B2 * | 2/2019 | Lance | F41C 33/002 |
| 2014/0263489 | A1 * | 9/2014 | Hendricks | F41C 33/002 224/150 |
| 2015/0241167 | A1 | 8/2015 | Bélanger | |

* cited by examiner

*Primary Examiner* — Corey N Skurdal
(74) *Attorney, Agent, or Firm* — Laine IP Oy

(57) ABSTRACT

The invention concerns a gun sling, gun equipment set, and methods of carrying a gun. The sling comprising a strap, a first buckle through which the strap passes so as to form a first length-adjustable loop, a second buckle through which the strap passes so as to form a second length-adjustable loop, a first gun attachment swivel arranged to the first loop, and a second gun attachment swivel arranged to the second loop. According to the invention, the strap is unitary and the first and second gun attachment swivels are capable of freely running along the first and second loops, respectively. The invention allows for versatile carry methods of rifle-type guns.

16 Claims, 5 Drawing Sheets

GUN SLING

FIELD

The invention relates to gun slings and gun equipment set comprising a gun sling. Slings of the present type comprise a strap and gun attachment swivels for connecting the sling with the gun to be carried. More specifically, the present disclosure provides a gun sling comprising a strap, a first buckle through which the strap passes so as to form a first length-adjustable loop, a second buckle through which the strap passes so as to form a second length-adjustable loop, a first gun attachment swivel arranged to the first loop, a second gun attachment swivel arranged to the second loop, wherein the strap is unitary and the first and second gun attachment swivels are capable of freely running along the first and second loops, respectively.

BACKGROUND

Rifles, such as hunting rifles and assault rifles, and other relatively sizeable and heavy guns are normally carried using a gun sling. Most conventional gun slings, when attached to conventionally equipped guns, are designed and suitable for a single or just few carry methods, which limit their scope of use. There are also some multipurpose slings, which suit for more carry methods.

U.S. Pat. No. 4,768,689 discloses a multi-purpose sling apparatus. It comprises strap and two gun attachment hooks. The sling is presented in two configurations, in first of which the strap forms one long loop and both hooks run along the same loop. In the second configuration, only one of the hooks runs along the loop and the second hook is fixedly attached to the strap.

U.S. Pat. No. 6,325,258 discloses a tactical sling system having several buckles and a ring-shaped member for providing a wearable backpack-style strap. One gun attachment hook or loop is fixedly attached to the strap.

U.S. Pat. No. 7,959,046 B2 discloses a multi-part sling with a single length-adjustment loop and several buckles and connectors for attachment of the gun in different configurations.

The gun slings of the prior art are limited in their suitability to multiple carry methods. In particular, none of the slings are suited for use with all seven carry methods disclosed in this application. The slings are also relatively difficult to re-adjust when changing from one carry method to another.

SUMMARY OF THE INVENTION

It is an aim of the invention to overcome problems discussed above and to provide a novel gun sling that suits for more carry methods and is easily adjustable between them.

It is also an aim of the invention to provide a novel gun equipment set comprising such gun sling and novel uses for such gun sling.

One aim is to provide a new method of arranging a gun into a carry position on a human-shaped figure carrying a gun using such gun sling.

The present gun sling comprises a strap, a first buckle through which the strap passes so as to form a first length-adjustable loop, a second buckle through which the strap passes so as to form a second length-adjustable loop, a first gun attachment swivel arranged to the first loop, and a second gun attachment swivel arranged to the second loop.

The strap is unitary and the first and second gun attachment swivels are arranged to freely run along the first and second loops, respectively.

The present gun equipment set comprises a gun and a gun sling of the above kind. The gun comprises three sling attachment elements at different longitudinal positions of the gun, the sling attachment elements being compatible with, i.e. capable of being engaged with, the gun attachment swivels of the gun strap so as to attach the gun to the sling.

The present method comprises arranging a gun into a carry position on a human-shaped figure as herein described and claimed.

More specifically, the invention is characterized by what is stated in the independent claims.

The invention offers significant benefits. By allowing the swivels to freely slide in separate length-adjustable loops, one can quickly adjust and wear the sling according to at least five different carry methods, more preferably according to at least seven carry methods. Benefits of the sling in each of these carry methods are described later in more detail.

The sling provides particular benefits in combination with a gun having three sling attachment points, each having a sling attachment element. Thus, all five (or more) carry methods described herein can be taken advantage of in full. To mention one example, in a novel carry method, the gun sling is worn by placing the first length-adjustable loop so that is goes on top of a shoulder of a first hand of a person (or other human-shaped figure) and under the armpit of the second hand of the person, whereby the second length-adjustable loop extends from the first buckle at the torso region of the person, and attaching the gun from a middle attachment point comprising a middle sling attachment element near the front end of the stock of the gun to the first gun attachment swivel. Thereby, the gun can hang vertically, barrel downwards, on the side of the person. When the swivel runs freely along the first loop, the gun can be lifted for aiming and shooting very rapidly. The second swivel is advantageously fastened to a counter-element attached to trousers of the person to keep it and the whole sling in place during action. This carry method is particularly suitable for hunters.

When variations of the carry methods are taken into account, the present sling suits for even more carry methods.

The sling is also very cost-efficient to manufacture. It can be made from one unitary linear strap, two buckles and two swivels, arranged in the presently disclosed way to form the two length-adjustable loops in which the swivels can slide.

The swivels running "freely" in the loops arranged to the strap by means of the buckles means that their position in the loops is not locked by means of friction or clamping, for example, but they find their optimal position in the loops along the strap due to forces applied to them, e.g. due to gravity and actions of the user when moving the gun.

The dependent claims are directed to selected embodiments of the invention.

The term "human-shaped figure" herein refers to living persons and artificial human models, such as mannequins, drawings, and digital 2D- and 3D-models of the human body.

Next, embodiments of the invention and advantages thereof are discussed in more detail with reference to the attached drawings.

EMBODIMENTS

First, use of the present sling in some different carry methods, as well as its advantages are described in detail with reference to FIGS. 1-5 and 6A-6C.

To use the sling for all seven carry methods, a rifle length weapon having three sling attachment points (first/front, second/middle and third/rear) is needed.

First carry method (FIG. 1): In this carry method, the sling 10 is worn by placing the first length-adjustable loop 10A so that is goes under the armpit of the first hand (dominant hand) of the person and is supported on top of the shoulder of the second hand (support hand) of the person. The first swivel 14A runs freely along this loop and is attached to a middle attachment point 22B of the gun 20. Thus, in this carry method, the gun is attached in one-point configuration. The gun 20 hangs vertically on the side of the person at the dominant hand side. This carry method may be termed a one-point sling.

Figure 1:
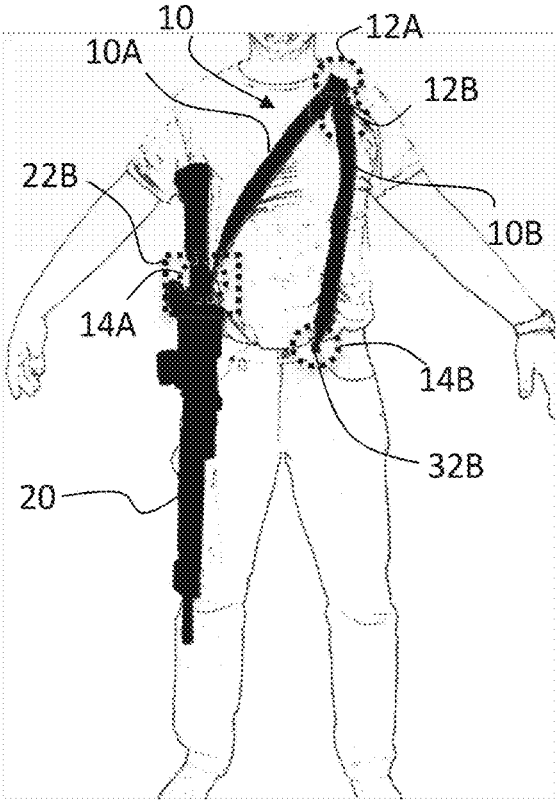
FIG. 1 shows the gun sling and a gun arranged according to a first carry method, the gun attached at a single point and vertically hanging on the side of a person.

The remaining strap, including the second length-adjustable loop 10B formed with the second buckle 12B, extends from the first buckle 12A at the torso region of the person. The second swivel 14B runs freely along the second loop 12B and is attached to equipment, clothing or hangs freely. In FIG. 1, the second swivel 14B is attached to a counterpart 32B attached to a belt loop of trousers, whereby it is held steadily in place.

As the first swivel 14A runs freely along the first loop 10A, the gun 20 finds a convenient and optimal position when not in use and can also be conveniently raised for aiming. Since the gun 20 is oriented parallel to the body, one is able to walk in a dense forest, for example.

Figures 6A, 6B, 6C:
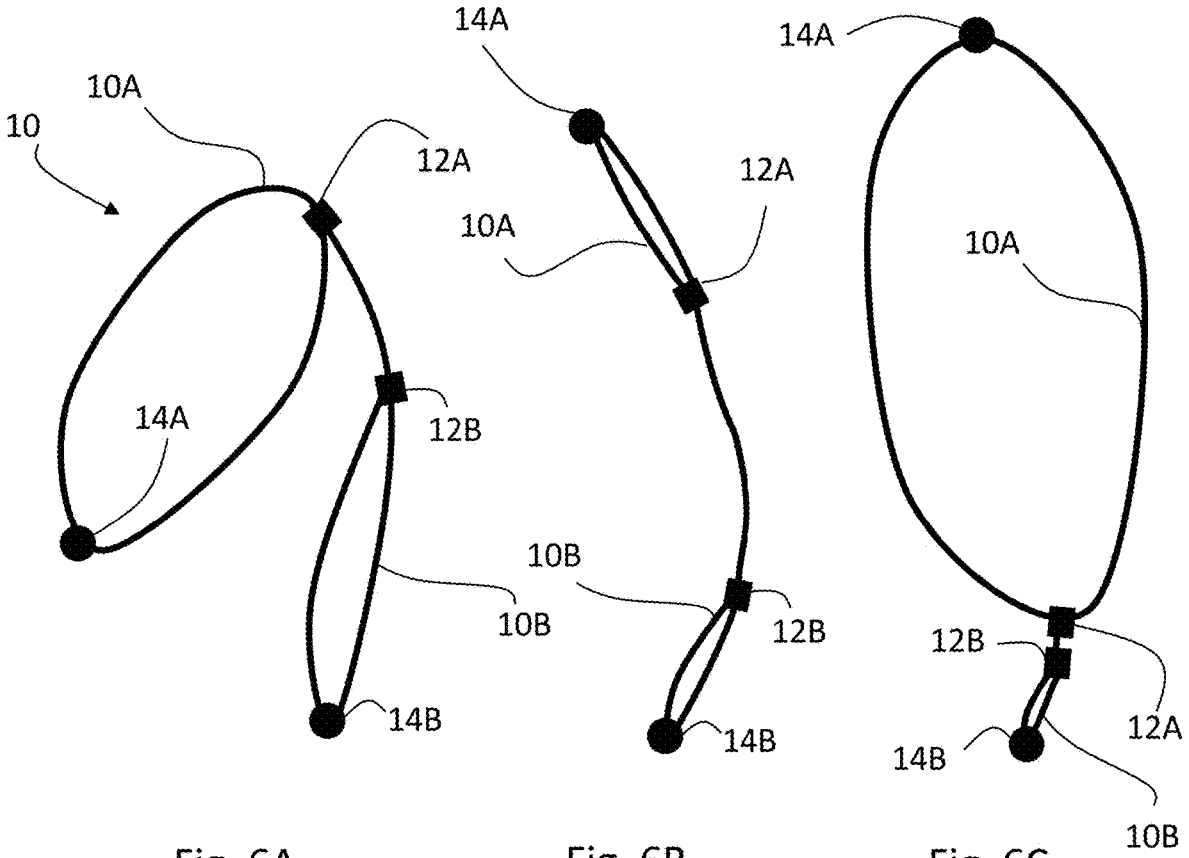
FIGS. 6A-6C show the gun sling in three different configurations as to the length of the loops.

In this carry method, the loop lengths are configured approximately as shown in FIG. 6A, depending on the size of the person.

Figure 5A:
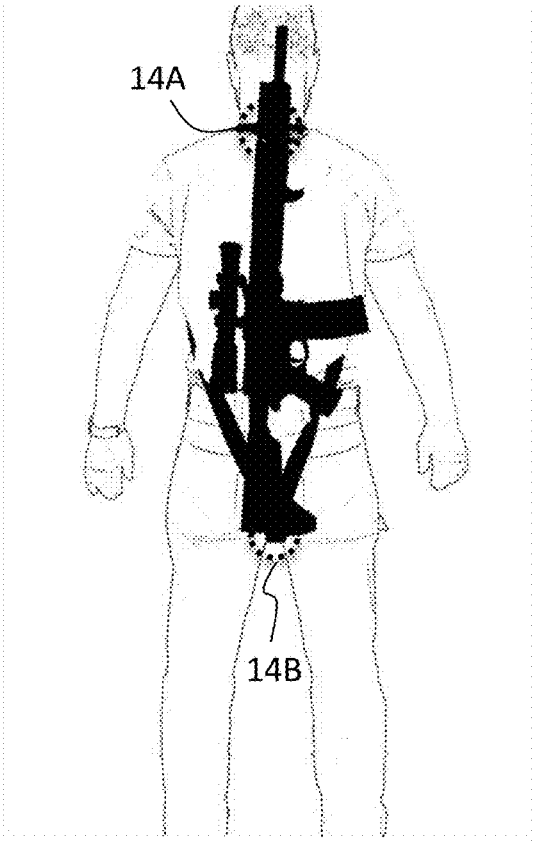
FIGS. 5A-5B show the gun sling and a gun arranged according to a fifth carry method, the sling forming backpack-style straps and the gun attached at two distant points and vertically arranged at the back of the person, barrel upwards.
Figure 5B:
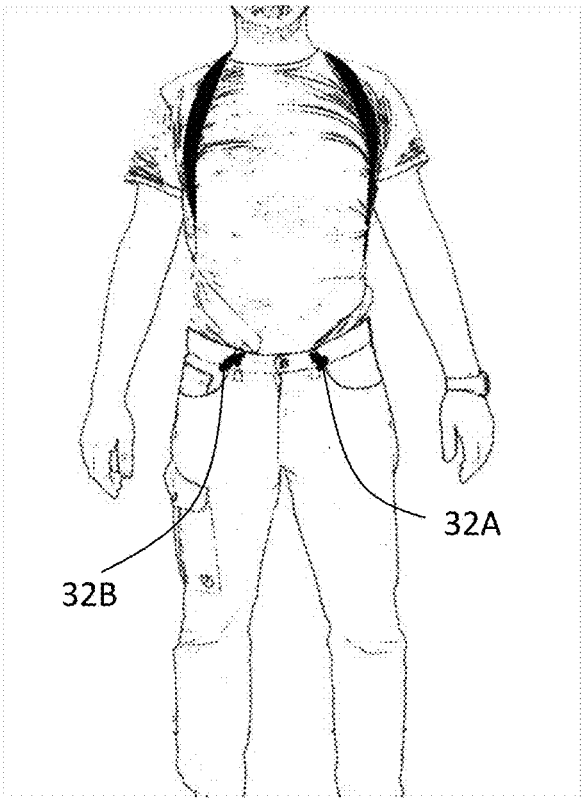

A zero-point carry method, wherein the gun is not attached to the strap, is achieved from the situation shown in FIG. 1 by removing the swivel from the gun and attaching said swivel to the user's belt, equipment or clothing. This allows the sling to be transported in a ready position without the gun. An example of the zero-point method is shown in FIG. 5B. Benefits of the zero-point carry method are discussed later within this disclosure.

In the following four carry methods, the gun is attached in different two-point configurations, in each of which the sling is being adjusted differently.

Second carry method (FIG. 2): In this carry method too, the sling 10 is worn by placing the first length-adjustable loop 10A so that is goes under the armpit of the first hand (dominant hand) of the person and is supported on top of a shoulder of a second hand (support hand) of the person. The first swivel 14A runs freely along this loop 10A and is attached to a middle attachment point 22B of the gun 20. The second swivel 14B in the second loop 10B is attached to the front attachment point 22A of the gun 20. The gun 20 hangs in oblique orientation in the front of the person, barrel pointing towards ground and ready to be lifted for aiming.

As the swivels 14A, 14B run freely along the loops 10A, 10B, the gun can be conveniently raised for aiming without detaching either of the swivels 14A, 14B.

Transition from the first carry method to the second carry method can be made simply by attaching the second swivel 14B to the front attachment point.

Figure 2:
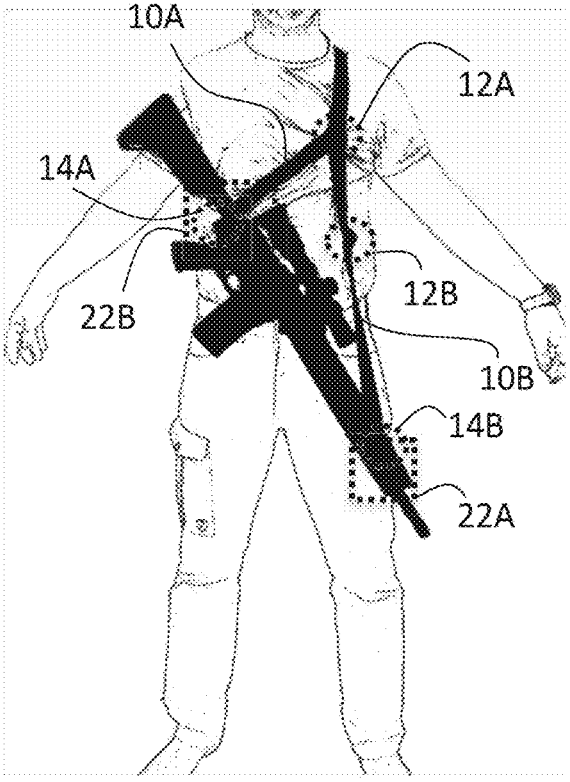
FIG. 2 shows the gun sling and a gun arranged according to a second carry method, the gun attached at two neighboring points and obliquely hanging in front of a person.
Figure 3A:
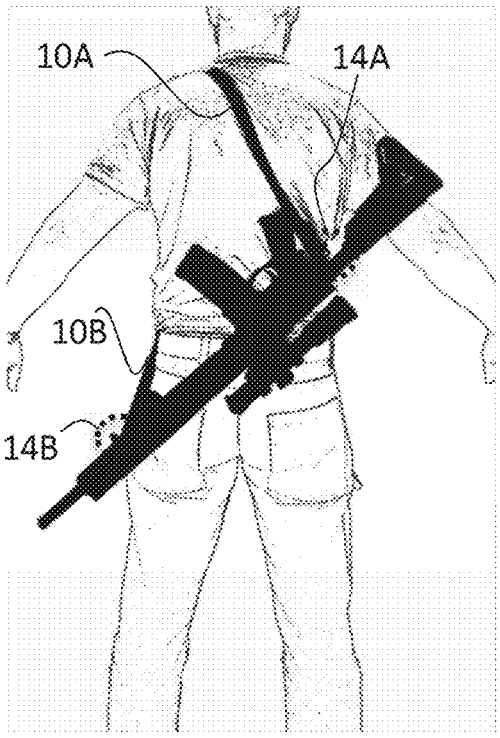
FIGS. 3A and 3B show the gun sling and a gun arranged according to a third carry method, the gun attached at two neighboring points and obliquely hanging behind a person.
Figure 3B:
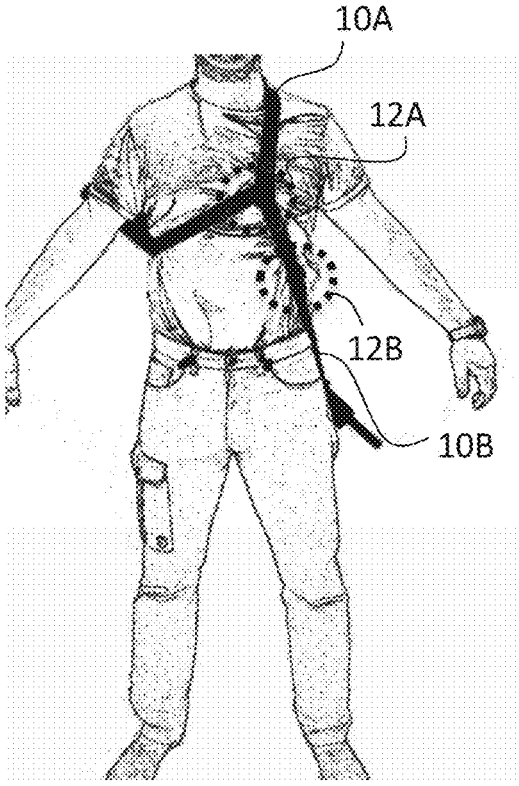

In a basic version of this carry method, shown in FIG. 2, the loop lengths are configured approximately as shown in FIG. 6A, depending on the size of the person. This carry method may be termed a three-point sling.

In a variation of the second carry method, the gun is carried barrel pointing obliquely upwards. The second loop 10B is adjusted to be shorter or as small as practically possible, whereby the second buckle 12B and the second swivel 14B are positioned close to the first buckle 12A, at a level higher than the first swivel 14A. The second swivel 14B in the second loop 10B is attached to the front attachment point 22A of the gun 20, whereby the gun is oriented diagonally in front of the chest. Tightening of the second loop 10B is easiest when the second swivel 14B is in released state. In this variation, the second swivel 14B must be released before aiming and shooting, as the gun is held tight against the torso. The variation is very suitable for e.g. marching, running or skiing with a gun. This variation may be called a ski-style sling.

For this variation, it is beneficial that the second swivel 14B is of quick release type, e.g. with a pull-release member, such as an emergency detachment swivel (e.g. Blue Force Gear™ Rapid Emergency Detachment Swivel).

Third carry method (FIGS. 3A and 3B): In this carry method too, the sling 10 is worn by placing the first length-adjustable loop 10A so that is goes under the armpit of the first hand (dominant hand) of the person and is supported on top of a shoulder of a second hand (support hand) of the person. The first swivel 14A runs freely along this loop 10A and is attached to a middle attachment point 22B of the gun 20. The second swivel 14B in the second loop 10B is attached to the front attachment point of the gun 20, but now the gun is at the back side of the person. As shown, the gun hangs conveniently and in oblique position behind the person. This carry method can be termed a three point sling behind back.

Transition from the first or second carry method to the third carry method can be made simply by releasing the second swivel 14B from the counterpart 32B, taking the gun to the back side and re-attaching the second swivel 14B to the front attachment point 22A.

In this carry method, the loop lengths are configured approximately as shown in FIG. 6A, depending on the size of the person.

Fourth carry method (FIG. 4): In this carry method, the gun 20 is attached from the first attachment point 22A to the first or second gun attachment swivel 14A; 14B and from the third sling attachment 22C element to the second or first gun attachment swivel 14B; 14A, respectively. Attachment of the latter swivel 14A; 14B is possible also to the middle attachment point 22B. The sling is worn by placing the first and second loops one after another, making the sling a short linear sling with double strap configuration in most positions. This carry method may be termed a two point sling.

Figure 4:
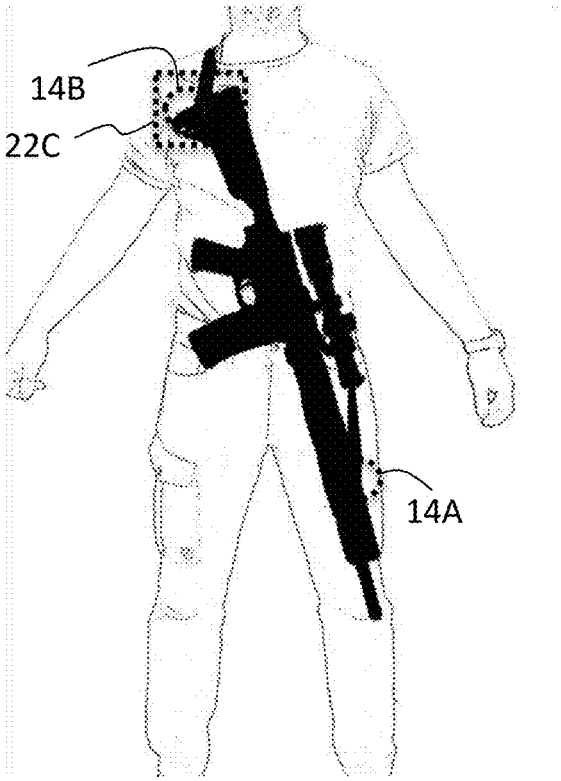
FIG. 4 shows the gun sling and a gun arranged according to a fourth carry method, the sling being linearly configured and the gun attached at two distant points and obliquely hanging in front of the person.

In a first variation, shown in FIG. 4, the sling goes on top of a shoulder of a first hand (dominant hand) of a person and under the armpit of the second hand of the person. The gun hangs barrel obliquely downwards on the front side of the person.

In a second variation, the gun hangs behind neck, whereby the strap is supported on top of both shoulders.

In a third variation, the gun is placed on the backside of the person, but otherwise similar to the first variation and FIG. 4.

In this carry method, the loop lengths are configured approximately as shown in FIG. 6B, depending on the size of the person and the distance between the sling attachment points of the gun.

Fifth carry method (FIGS. 5A and 5B): In this carry method, the gun 20 is attached from the first attachment point 22A to the first or second gun attachment swivel 14A; 14B and from the third sling attachment 22C element to the second or first gun attachment swivel 14B; 14A, respectively. Attachment of the latter swivel 14A; 14B is possible also to the middle attachment point 22B, depending on the length of the gun and the back of the person.

The first loop 10A of the sling, where the first swivel 14A is located, is arranged loose, i.e. a large loop, and the second loop 10B, where the second swivel 14B is located, is arranged tight (or vice versa). The sling is worn around left and right shoulder, like a backpack, on the backside of the person, from the longer loop 10A. Preferably, the tight loop 10B is placed lower, so that the openly running swivel comes towards the neck of the person, like shown in FIG. 5A. In other words, the swivel 14A is preferably fastened to the front attachment point of the weapon and the swivel 14B is fastened to the rear attachment point of the weapon. This carry method may be termed a harness sling.

In this carry method, the loop lengths are configured approximately as shown in FIG. 6C, depending on the size of the person and the distance between the sling attachment points of the gun.

Preferable properties of the sling are listed in the following paragraphs.

The length of the strap of the sling is preferably at least 160 cm and in particular at least 200 cm, for example 180-300 cm, such as 200-250 cm. In at least one exemplary embodiment the length of the strap of the sling may be at least 300 cm long, for example 250 cm long. Different strap lengths may be provided for different sized people, for example small (S), medium (M), large (L) and extra-large (XL, XXL, XXXL) lengths may be provided.

The width of the strap can be e.g. 2-6 cm, such as 2.5-5.0 cm, preferably being 2.5-4.0 cm.

The strap is preferably a woven strap made of natural or synthetic yarns.

The strap is preferably unitary, of constant width and thickness, and free of branches.

In at least the first, second, third and fifth carry method, the first loop 10A is typically adjusted to be longer (measured along the strap) than the second loop 10B.

The first buckle 12A is preferably a ladderlock type of buckle.

The first buckle 12A is preferably attached to one end of the strap permanently, for example by stitching, welding, thermocompression, weaving, and/or using adhesive.

The first buckle 12A is the first loop 10A size adjuster buckle and also the primary sling length adjuster buckle. Therefore, it may have an extension extending asymmetrically therefrom for allowing fast release of the strap to slide therethrough and for quick first loop 10A length adjustment.

In at least one exemplary embodiment, the first buckle 12A may be a so-called tension lock buckle such as a ladderlock buckle. A tension lock buckle retains its position relative to the strap even if force is exerted on the strap. In other words such a buckle remains stationary when the strap is being pulled. A benefit of the tension lock buckle is that it may withstand forces such as the user pushing the gun against the strap for support when shooting, but the buckle is also rapidly adjustable without any special tools in case the loop needs to be loosened. In order to achieve good weapon mobility and rapid transitions between the carrying methods, it is beneficial for further exemplary embodiments to have at least one tension lock buckle as well as glide buckles such as triglide buckles as part of the strap. Such a combination provides an optimal mix of fixed and movable buckles which provides the aforementioned benefits and may be rapidly adjusted in all situations.

The second buckle 12B is preferably a tri-glide type of buckle. The second buckle may be a glide-type buckle.

The second buckle 12B is preferably not attached to the strap permanently, but can be removed therefrom through its free end.

The second buckle 12B can be symmetric or asymmetric in the length direction of the strap. Also the second buckle 12B may have an extension extending asymmetrically therefrom for allowing fast release of the strap to slide therethrough and for quick second loop 10B length adjustment.

Both buckles 12A, 12B are designed to maintain the length of the respective loops 10A, 10B when a pull force is subjected to the strap from different sides of the buckle. Preferably, this maintaining is based on friction and compression of the strap by the buckle. It is, however, not excluded that the buckles contain pins engaging with the strap or some other mechanism that assists in locking the strap in the buckle.

The swivels 14A, 14B, or at least the first swivel 14A, need to be of the type that can run loose, i.e. without significant friction, along the strap, along the loops 10A, 10B, respectively. Thus, the swivels 14A, 14B contain a first portion having an aperture that is equal in size or larger than the cross-sectional footprint of the strap and through which the strap is threaded.

The swivels 14A, 14B also contain a second portion containing means for locking the swivel to a corresponding counter-element attached to the gun or clothes, for example, and a release mechanism.

The swivels 14A, 14B, or at least their locking means, are preferably identical.

The swivels 14A, 14B are preferably made of metal, typically entirely.

The swivels 14A, 14B preferably include a spring mechanism for engaging corresponding counter-elements positioned at the gun attachment points 22A, 22B, 22C, or clothes of the user.

The swivels 14A, 14B can be e.g. male button-release gun swivels, such as push-button release gun swivels or pull-button release gun swivels, or latch-release hook gun swivels. Such gun swivels are available e.g. from Blue Force Gear.

In one preferred embodiment, the swivels are Quick Detach (QD) swivels, such as Magpul Quick Detach (QD) swivels, which are known in the art. The swivels may have a protruding or flush push button.

In one preferred embodiment, the swivels are HK (i.e., H&K) style hook swivels, which are also known in the art.

In one preferred embodiment, the swivels are Magnum swivels, which are known in the art.

In one preferred embodiment, the swivels are Magpul Paraclip swivels, which are known in the art.

In one preferred embodiment, the swivels, or at least the second swivel 14B, are Rapid Emergency Detachment swivels. They may contain for example a pull-release mechanism for quick release.

The two swivels 14A, 14B can also be different from each other, chosen for example from the abovementioned gun swivel types.

In some embodiments, the sling consists of the strap, the first and second buckle, the first and second swivel, and, optionally, one or two counter-elements capable of engaging the first and second swivels. That is, there are no other components that are essential to assembling of the sling or carrying the gun according to the discussed carry methods.

Figure 7:
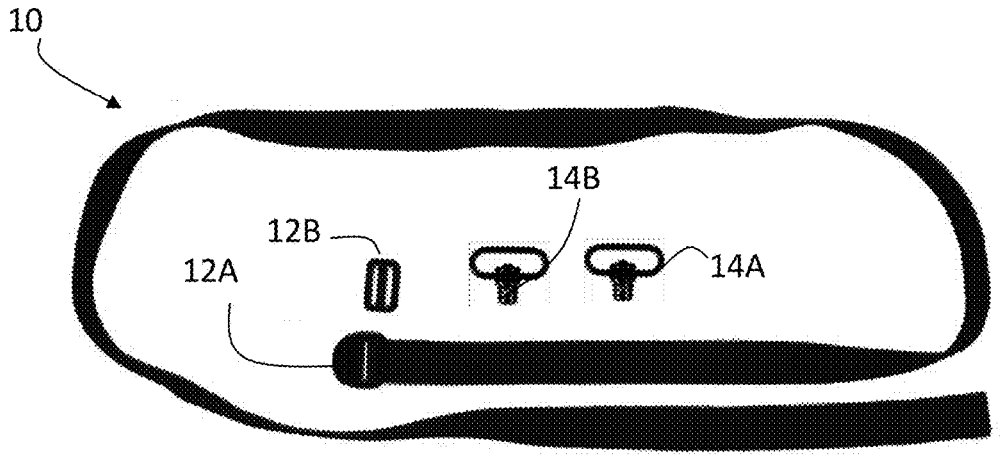
FIG. 7 shows key parts of the sling, sufficient for making a working product.

Assembling of the sling: The sling can be assembled from its basic elements shown in FIG. 7 into full use condition in the following way:

1. Providing a linear strap, first and second buckles 12A, 12B, and first and second swivels 14A, 14B.
2. Attaching one end of the strap to the first buckle 12A (condition of FIG. 7).
3. Running the free end of the strap through first swivel 14A.
4. Running the free end of the strap through first buckle 12A.
5. Running the free end of the strap through second buckle 12B.
6. Running the free end of the strap through second swivel 14B.
7. Running the free end of the strap again through second buckle 12B.
8. By this process, a sling as described above is achieved.

Further aspects of the invention are listed in the following paragraphs.

In some embodiments, the sling comprises in addition to the basic elements, also one or more, such as one, two, three, four or five, counter-elements for the swivels 14A, 14B so as to form a complete carry set for a gun. The counter-elements are for attachment to the gun attachment points 22A, 22B, 22C, and/or clothing (see elements 32A, 32B in FIGS. 1 and 5). In one preferred embodiment, at least the counter-elements 32A, 32B for clothing are included. The counter-elements 32A, 32B allow the sling to be worn also when the gun is not attached thereto, without the loops and swivels hanging freely (zero-point carry). It is for example convenient to sit down with the sling worn when the swivels 14A, 14B are attached to counter-elements 32A, 32B, respectively.

The counter-elements can be e.g. female QD swivels, loops. The counter can comprise e.g. latch-release or alligator clip-release mechanism for releasable attachment to clothing.

According to some aspects, there is provided a gun equipment set comprising a gun sling as described above and a long, rifle-type gun. The gun is provided with counter-elements for the swivels 14A, 14B at three different attachment points thereof along its longitudinal direction.

In a preferred configuration, the first attachment point 22A is located in the front half, preferably in the frontmost third, of the barrel portion, which is defined herein as the part of the gun located in front of the trigger.

In a preferred configuration, the second attachment point is located in the front half of the stock portion of the gun, herein defined as the part of the gun located behind the trigger, and the third attachment point is located in the back half of the stock portion.

The gun can be e.g. a hunting rifle, shotgun, assault rifle or sniper rifle.

In some embodiments, the gun is a single-barreled or double-barreled shotgun.

In some particularly preferred embodiments, the gun is a single-shot hunting rifle. Such rifles are conventionally attached to the sling only from the barrel (first) and end-of-stock (third) attachment points and do not contain the middle (second) attachment point at all. In particular, the first carrying method discussed herein offers a novel carry method for hunting.

In some embodiments, the second and third attachment points, i.e., the counter-elements of the respective swivels of the sling, are positioned on different sides of the stock (laterally with respect to a vertical plane coinciding with the longitudinal axis of the gun). That is one, typically the second attachment point closer to the trigger is positioned on the left hand side of the stock and the third attachment point is positioned on the right hand side of the stock. This configuration suits well for right-handed shooters, whereby for example in the first carry method, the rifle can hang like shown in FIG. 1.

The first and third attachment points are typically positioned on the same lateral side of the gun.

Figure 8A:
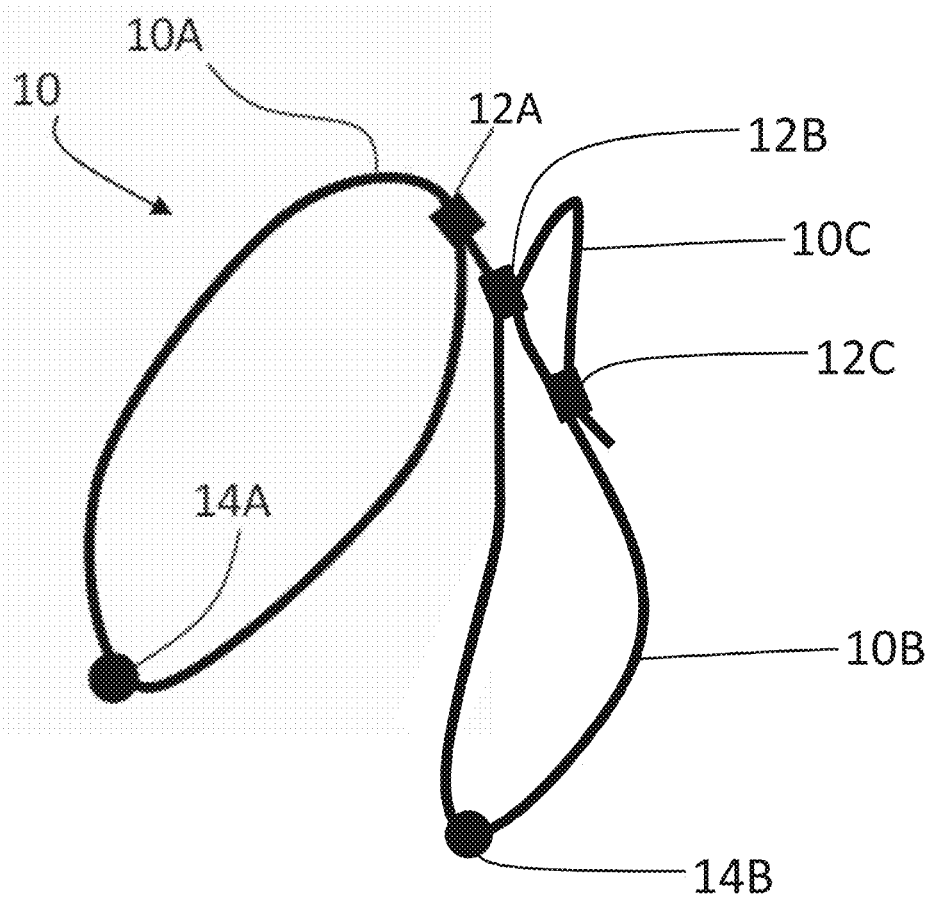
FIGS. 8A and 8B shows a further embodiment, wherein the sling also comprises a third loop and buckle.

In an exemplary embodiment usable with at least some of the embodiments disclosed within, the sling as shown in FIG. 8A comprises a third buckle 12C which is arranged with buckle 12B to form loop 10C in the sling. The free end of the sling may protrude from buckle 12C. In at least some embodiments, the loop 10C may be formed between buckles 12B and 12C so that the loop includes at least a part of said buckles 12B and 12C. The arrangement of the sling with the loop 10C and the buckle 12C and 12B is usable with any of the carry methods and variations thereof within this disclosure and is especially suitable for the second and fourth carry methods.

Third buckle 12C may be similar to first buckle 12A, or second buckle 12B. In a preferred embodiment, the buckle 12C is a triglide buckle. In particular, the disclosure above relating to said first and second buckle is expressly applicable to the third buckle 12C. In at least one exemplary embodiment, the third buckle 12C is preferably a tri-glide type of buckle and is preferably not attached to the strap permanently, but can be removed therefrom through its free end.

Figure 8B:
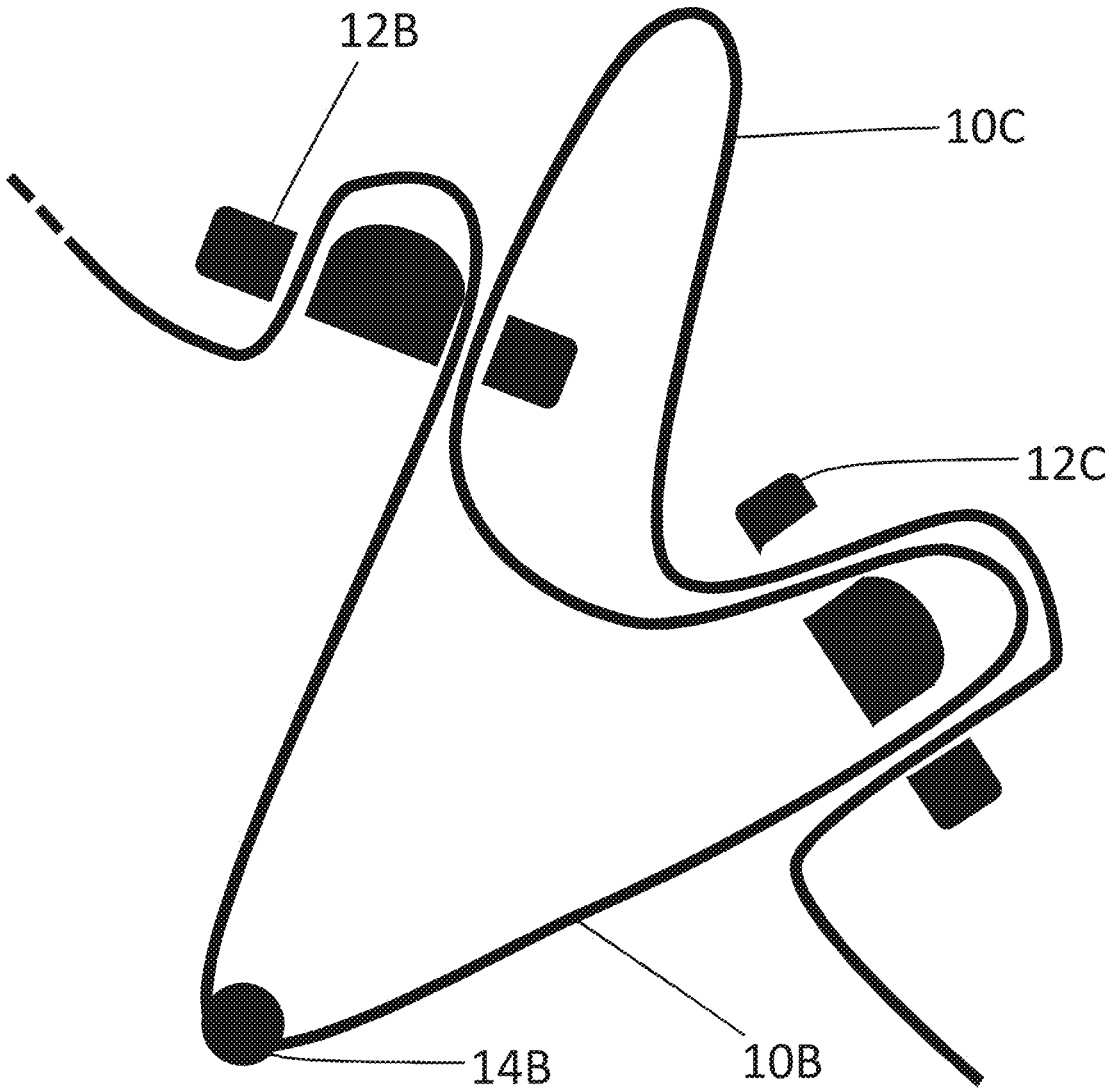

FIG. 8B shows an exemplary schematic (not to scale) wherein the arrangement of the strap and the buckles is shown in greater detail. For the sake of clarity, the portion of the strap related to loop 10A and swivel 14A is omitted from the figure. The strap continues from said portion relating to loop 10A and passes though both mouths of buckle 12B and then through swivel 14B. It then passes through both mouths of buckle 12C and one mouth of buckle 12B. Thus the loop 10B is formed starting and ending from the buckle 12B. The strap passes back to the buckle 12C and passes through both mouths of said buckle. The portion of the strap after buckle 12B and before re-entry into buckle 12C is the loop 10C. The free end of the strap protrudes from buckle 12C.

Third buckle 12C is arranged with the other components of the strap to provide loop 10C as previously discussed. Loop 10C may be arranged to have a length from 3 centimeters to 20 centimeters, preferably 8 to 13 centimeters or even more preferably the width of the user's hand. Loop 10C is usable as a handle to adjust at least one of: the position of the sling or the size of the other loops, in particular loop 10B. A beneficial effect of having loop 10C for adjustment purposes in comparison to adjusting the buckle 12B directly is the increased contact surface of the loop 10C compared to the relatively small surface of the buckle 12B. Such a contact surface allows for increased force and speed in the adjustment and allows the user to adjust the sling even when not looking at the sling. A user may insert their hand into the loop C to adjust the strap.

As shown in FIGS. 8A and 8B, the loops 10B and 10C are interlinked by the strap and the buckles 12B and 12C. When loop 10C is used to adjust the size of loop 10B, loop 10C is pulled by the user in a first direction, e.g. towards the end of loop 10B, the force being exerted on loop 10C is transmitted to buckle 12B, which slides along the sling in said first direction. Said first direction can also be understood as from 12A towards 14B along the sling. In such a situation the buckles 12B and 12C may contact each other as the buckle 12C is also pulled in the first direction. As the loop 10B is defined by the position of buckle 12B, moving the buckle 12B in the first direction makes the loop 10B smaller. When the buckles 12B and 12C contact each other, they may in some situations be moved and/or adjusted simultaneously. Said buckles in that situation may be referred to as buckle 12BC.

Adjusting the loop 10B in a second direction, which is opposite to the first direction, may be done by pulling on the loop 10C. As loop 10C is connected to buckle 12B which forms loop 10B, pulling loop 10C will move the buckle 12B and enlarge the loop 10B.

It is to be understood that the embodiments of the invention disclosed are not limited to the particular structures, process steps, or materials disclosed herein, but are extended to equivalents thereof as would be recognized by those ordinarily skilled in the relevant arts. It should also be understood that terminology employed herein is used for the purpose of describing particular embodiments only and is not intended to be limiting.

Reference throughout this specification to one embodiment or an embodiment means that a particular feature, structure, or characteristic described in connection with the embodiment is included in at least one embodiment of the present invention. Thus, appearances of the phrases "in one embodiment" or "in an embodiment" in various places throughout this specification are not necessarily all referring to the same embodiment. Where reference is made to a numerical value using a term such as, for example, about or substantially, the exact numerical value is also disclosed.

As used herein, a plurality of items, structural elements, compositional elements, and/or materials may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary. In addition, various embodiments and example of the present invention may be referred to herein along with alternatives for the various components thereof. It is understood that such embodiments, examples, and alternatives are not to be construed as de facto equivalents of one another, but are to be considered as separate and autonomous representations of the present invention.

Furthermore, the described features, structures, or characteristics may be combined in any suitable manner in one or more embodiments. In this description, numerous specific details are provided, such as examples of lengths, widths, shapes, etc., to provide a thorough understanding of embodiments of the invention. One skilled in the relevant art will recognize, however, that the invention can be practiced without one or more of the specific details, or with other methods, components, materials, etc. In other instances, well-known structures, materials, or operations are not shown or described in detail to avoid obscuring aspects of the invention.

While the forgoing examples are illustrative of the principles of the present invention in one or more particular applications, it will be apparent to those of ordinary skill in the art that numerous modifications in form, usage and details of implementation can be made without the exercise of inventive faculty, and without departing from the principles and concepts of the invention. Accordingly, it is not intended that the invention be limited, except as by the claims set forth below.

The verbs "to comprise" and "to include" are used in this document as open limitations that neither exclude nor require the existence of also un-recited features. The features recited in depending claims are mutually freely combinable unless otherwise explicitly stated. Furthermore, it is to be understood that the use of "a" or "an", that is, a singular form, throughout this document does not exclude a plurality.

INDUSTRIAL APPLICABILITY

At least some embodiments of the present invention find industrial application relating to testing or use of firearms.

The invention claimed is:

1. A gun sling comprising:

a strap, a first buckle which the strap passes through so as to form a first length-adjustable loop, a second buckle which the strap passes through so as to form a second length-adjustable loop, a third buckle which the strap passes through so as to form a third length-adjustable loop, said third length-adjustable loop passing through the second buckle in addition to the third buckle, a first gun attachment swivel arranged to the first loop, and a second gun attachment swivel arranged to the second loop, wherein the strap is unitary and the first and second gun attachment swivels are capable of freely running along the first and second loops, respectively and wherein the first buckle is a strap adjuster buckle fixedly attached at one end of the strap.

2. The gun sling according to claim 1, wherein the first and second gun attachment swivels are male button-release swivels, pull-release swivels or latch-release hook swivels.

3. The gun sling according to claim 1, wherein the first buckle has an extension extending asymmetrically therefrom for fast loop length adjustment.

4. The gun sling according to claim 1, wherein the first buckle is a ladderlock buckle fixedly attached at one end of the strap.

5. The gun sling according to claim 1, wherein the second buckle is a triglide slide buckle non-fixedly arranged to the strap.

6. The gun sling according to claim 1, wherein the strap is a linear flexible strap, such as a woven strap, with a length at least 250 centimeters, and a width of 2-5 centimeters.

7. The gun sling according to claim 1, wherein the first loop is adjusted to be longer than the second loop.

8. The gun sling according to claim 1, further comprising at least one, preferably two, sling attachment elements capable of engaging with the first and second gun attachment swivels and capable of being attached to waist or belt loops of trousers.

9. The gun sling according to claim 1, consisting of the strap, the first and second buckle, the first and second swivel, and, optionally, one or two counter-elements capable of engaging the first and second swivels.

10. The gun sling according to claim 9, wherein said third length-adjustable loop is configured so that said third length-adjustable loop may be used to alter the size of the second length-adjustable loop.

11. A gun equipment set comprising:

a gun, and a gun sling comprising:

a strap, a first buckle which the strap passes through so as to form a first length-adjustable loop, a second buckle which the strap passes through so as to form a second length-adjustable loop, a third buckle which the strap passes through so as to form a third length-adjustable loop, said third length-adjustable loop passing through the second buckle in addition to the third buckle, a first gun attachment swivel arranged to the first loop, and a second gun attachment swivel arranged to the second loop, wherein the strap is unitary and the first and second gun attachment swivels are capable of freely running along the first and second loops, respectively and wherein the first buckle is a strap adjuster buckle fixedly attached at one end of the strap, wherein the gun comprises three sling attachment elements compatible with the gun attachment swivels of the gun sling, the three sling attachment elements being positioned at different longitudinal positions of the gun.

12. The gun equipment set according to claim 11, wherein the gun is a rifle having a stock and a barrel, the first sling attachment element is positioned close to the rear end of the stock of the gun, on one lateral side, such as right side thereof, the second sling attachment element is positioned close to the front end of the stock of the gun, typically on the other lateral side, such as left side of the gun, and the third sling attachment element is positioned at the barrel region of the gun.

13. The gun equipment set according to claim 11, wherein the first gun attachment swivel is engaged with the second sling attachment element and the second gun attachment swivel is engaged with the third sling attachment element.

14. The gun equipment set according to claim 11, wherein said third length-adjustable loop is configured so that said length-adjustable loop may be used to alter the size of the second length-adjustable loop.

15. A method of arranging a gun into a carry position on a human-shaped figure, the method comprising:

providing a gun equipment set comprising a gun, and a gun sling comprising:

a strap, a first buckle which the strap passes through so as to form a first length-adjustable loop, a second buckle which the strap passes through so as to form a second length-adjustable loop, a third buckle which the strap passes through so as to form a third length-adjustable loop, said third length-adjustable loop passing through the second buckle in addition to the third buckle, a first gun attachment swivel arranged to the first loop, and a second gun attachment swivel arranged to the second loop, wherein the strap is unitary and the first and second gun attachment swivels are capable of freely running along the first and second loops, respectively and wherein the first buckle is a strap adjuster buckle fixedly attached at one end of the strap, wherein the gun comprises three sling attachment elements compatible with the gun attachment swivels of the gun sling, the three sling attachment elements being positioned at different longitudinal positions of the gun, and either placing the first length-adjustable loop so that is goes under the armpit of a first hand of the figure and on top of a shoulder of the second hand of the figure and, whereby the second length-adjustable loop extends from the first buckle at the torso region of the figure, and attaching the gun from the second sling attachment element to the first gun attachment swivel, and either allowing the gun to hang vertically on the first hand side of the figure, or attaching the gun from the third sling attachment element to the second gun attachment swivel in front of the figure, and allowing the gun to hang on the frontside of the figure, or attaching the gun from the third sling attachment element to the second gun attachment swivel behind the figure, and allowing the gun to hang on the backside of the figure, or attaching the gun from the first sling attachment element to the first or second gun attachment swivel and from the third sling attachment element to the second or first gun attachment swivel, respectively, and either placing the first and second length-adjustable loops successively so that the sling forms a linear entity that goes on top of a shoulder of a first hand of the figure and under the armpit of the second hand of the figure, whereby the gun hangs barrel obliquely downwards, or positioning different portions of the first length-adjustable loop like backpack straps around shoulders of the figure, whereby the gun sits towards the back of the figure in vertical orientation.

16. The method according to claim 15, wherein said third length-adjustable loop is configured so that said length-adjustable loop may be used to alter the size of the second length-adjustable loop.

* * * * *